US006834571B1

(12) United States Patent
Lowe et al.

(10) Patent No.: US 6,834,571 B1
(45) Date of Patent: Dec. 28, 2004

(54) DUAL HEADED PLIERS WITH POMMELED HANDLES

(76) Inventors: Joseph T. Lowe, 2324 Raintree Dr., Brea, CA (US) 92821; Richard G. Lowe, 3909 Springcress Dr., Columbia, MO (US) 65202

( * ) Notice: Subject to any disclaimer, the term of this patent is extended or adjusted under 35 U.S.C. 154(b) by 175 days.

(21) Appl. No.: 10/231,952

(22) Filed: Aug. 30, 2002

Related U.S. Application Data

(63) Continuation-in-part of application No. 09/871,985, filed on Jun. 4, 2001.

(51) Int. Cl.[7] ..... B25B 7/00
(52) U.S. Cl. ..... 81/427.5; 7/107
(58) Field of Search ..... 81/427.5; 7/107, 7/127, 128

(56) References Cited

U.S. PATENT DOCUMENTS 5,245,721 A * 9/1993 Lowe et al. ..... 7/129

FOREIGN PATENT DOCUMENTS

| | | | |
|---|---|---|---|
| DE | 3019734 | * 12/1981 | ..... 81/427.5 |
| GB | 2053071 | * 2/1981 | ..... 81/427.5 |

* cited by examiner

*Primary Examiner*—James G. Smith
(74) *Attorney, Agent, or Firm*—Jack C. Munro

(57) ABSTRACT

A pliers which has a pair of heads with these heads being reversible so that one head is in a usage position the other head is in a stowage position located between a pair of handles. Each handle of the pair of handles is pivotable about one hundred sixty degrees with the handles to be located in juxtaposition in both the usage position and the stowage position. Each handle including a convex surface and a concave surface and also each handle including a pommel. Each of the convex surfaces and each of the concave surfaces and each of the pommels function to ergonomically assist in grasping of the handles.

9 Claims, 3 Drawing Sheets

DUAL HEADED PLIERS WITH POMMELED HANDLES

REFERENCE TO PRIOR APPLICATION

This application is a continuation-in-part of U.S. patent application Ser. No. 09/871,985, filed Jun. 4, 2001 by the same title and the same inventors.

BACKGROUND OF THE INVENTION

1. Field of the Invention

This invention relates generally to tools and more particularly to a pliers type of tool which embodies a pair of different heads within the same tool.

2. Description of the Related Art

Hand tools, of different types, have long been known. A common form of a hand tool is what is known as a pliers. A pliers has a head which is defined by a pair of jaws which can be manipulated by a pair of handles into a pincher-like action on an exterior structure. There are different types of plier heads. There is what is deemed a sharp nose or needle nose type of pliers head. There is also what is referred to as a snub nose type of pliers head. Tradesmen and homeowners frequently carry both types of pliers on their person or within their toolbox. If both heads could somehow be incorporated within a single tool, then the tradesman or homeowner would only be required to carry a single tool rather than two different tools.

In the past, it has been known to form a combination type of tool in the form of a pliers wherein two different types of heads of pliers are incorporated within a single tool. Reference is to be had to prior U.S. Pat. No. 5,245,721 which shows such a combination tool. However, the combination tool of the prior art has certain deficiencies. One of the deficiencies is that the handles are not constructed to ergonomically fit into the user's hand. The combination tool of the mentioned prior art patent utilizes bulbous shaped handles. When a human grasps a pair of pliers, the bulbous shaped handle will fit nicely within the palm area of the hand but the fingers don't connect well with a bulbous shaped handle. It would be desirable to have the fingers go into a cavity rather than an outwardly rounded handle. Also, it would be desirable that regardless which position the handles are in, and depending upon which head is being used, that the fingers are located within a handle concavity.

Additionally, the handles of the combination tool of the prior art previously mentioned does not include any kind of protuberance or pommel which can be used by the user as a "feel" device to inform the user that he or she has correctly grasped the tool. It is to be noted that in some instances, the use of the tool is accomplished in a poorly lighted or unlighted environment. Therefore, the use of such a "feel" device would be desirable. Additionally, during use of a conventional pliers or a combination type pliers of the prior art reference, there is a natural tendency for the user's hands to slide upward on the handles which results in the hand not being placed in the most desirable location in order to apply the maximum amount of torque. It would be desirable to include some type of structure in conjunction with the handles that would tend to prevent the user's hand from sliding on the handles.

SUMMARY OF THE INVENTION

The basic embodiment of the present invention comprises a pliers which has a first pliers head and a second pliers head located opposite the first pliers head. A first handle and a second handle are connected at a pivot joint between the first pliers head and the second pliers head. The first handle has a convexly curved surface with the second handle also having a convexly curved surface. Both the first handle and second handle are movable within a plane, and each convexly curved surface is located transverse to that plane. One of the convexly curved surfaces forms an interior surface of the handle of the pliers when the first pliers head is located in the usage position and the other convexly curved surface forms an interior surface of the handles when the second pliers head is in the usage position. The first handle has a concave surface located opposite the convex surface. The second handle has a concave surface located opposite the convex surface of this second handle.

In a further embodiment of this invention, is where the basic embodiment has been modified so that the stowage position is located between the handles.

In a still further embodiment of this invention, is where the basic embodiment has been modified to include a first pommel found on the first handle with the first pommel being located on the surface of the handle which is opposite the first convexly curved surface on that handle with this pommel to function as a positioning device to assist in determining proper positioning of the pliers within a user's hand.

In a yet still further embodiment of this invention, is where the basic embodiment has been modified where the second handle includes a second pommel with the second pommel being located on a surface of the second handle which is opposite the convexly curved surface. Again, the second pommel is to assist in determining proper positioning of the pliers within a user's hand.

In a still further embodiment of this invention, the basic embodiment is modified to where the first pommel and the second pommel are spaced approximately two inches from the pivot axis of the connecting joint with the free ends of the handles being spaced approximately five and one-half inches from the pivot axis of the connecting joint.

A modified embodiment of the present invention is where there is utilized a pliers which has a pair of heads with these heads being reversible between a usage position and a stowage position. The pliers includes a pair of handles each of which is pivotable relative to the heads with the outer limits of this movement determining the usage position and the stowage position. The handles are to be placed located in juxtaposition in both the usage position and the stowage position. Each handle includes a convex surface and a concave surface with these surfaces functioning to ergonomically assist in grasping of the handles.

In yet a still further embodiment of this invention, the modified embodiment is defined to include a pommel on each handle with each pommel to further assist ergonomically grasping of the handles.

In yet a further embodiment of this invention, the modified embodiment is defined to state that each handle is pivotable about one hundred sixty degrees from the outer limit of movement of the handles.

In yet a further embodiment of this invention, the modified embodiment is defined to state that each pommel is located directly against a concave surface of its respective handle.

A further modified embodiment of the present invention is where there is utilized a pair of pliers which has a pair of heads with these heads being reversible between a usage position and a stowage position. The pliers includes a pair of handles each of which is pivotable relative to the heads with the outer limits of this movement determining the usage position and the stowage position. The handles are to be placed in juxtaposition in both the usage position and the stowage position. Each handle has a pommel with each pommel to ergonomically assist in grasping of the handles.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
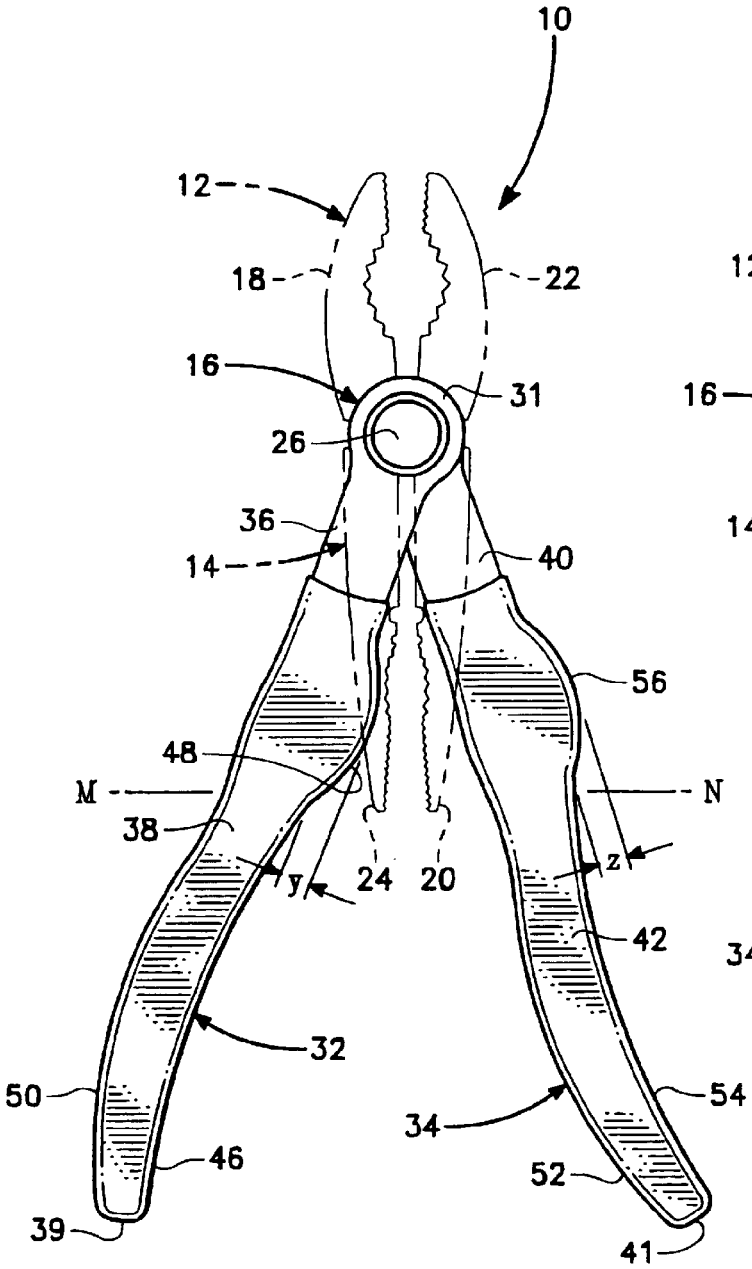
FIG. 1 is a top plan view of the pliers constructed in accordance with this invention showing the snub nose pliers head being located in the usage position and the needle nose pliers head located in the stowage position.
Figure 2:
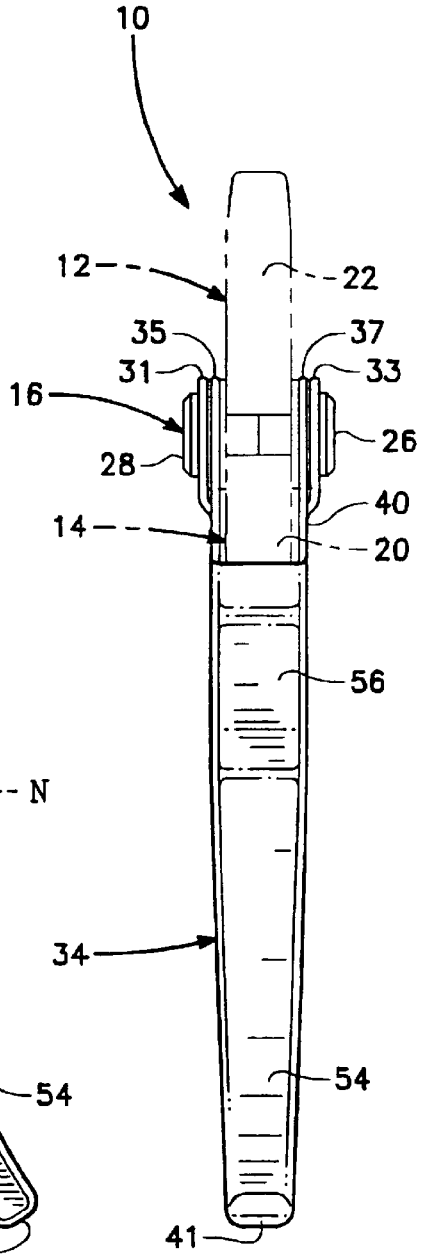
FIG. 2 is a right side elevational view of the pliers of FIG. 1.

Referring particularly to the drawings, there is shown a pliers 10 of this invention which has a snub nose pliers head 12 and a needle nose pliers head 14. The snub nose pliers head 12 and the needle nose pliers head 14 are connected together at a connecting joint 16. Basically, the snub nose piers head 12 is located opposite the needle nose pliers head 14. Jaw element 18 of the snub nose pliers head 12 is integrally connected to jaw element 20 of the needle nose pliers head 14. The jaw element 22 of the snub nose pliers head 12 is integrally connected to jaw element 24 of the needle nose pliers head 14.

The connecting joint 16 includes a pair of secured together large headed pins 26 and 28. Extending longitudinally through the center of the pins 26 and 28 is a pivot axis 30. Included within the connecting joint 16 is a spring arrangement, which is not shown, whose purpose is to exert a continuous bias between the jaw elements 18, 20, 22 and 24 so as to be the normal tendency to locate jaw elements 18 and 22 in a totally open position and also the jaw elements 20 and 24 in a totally open position.

Figure 3:
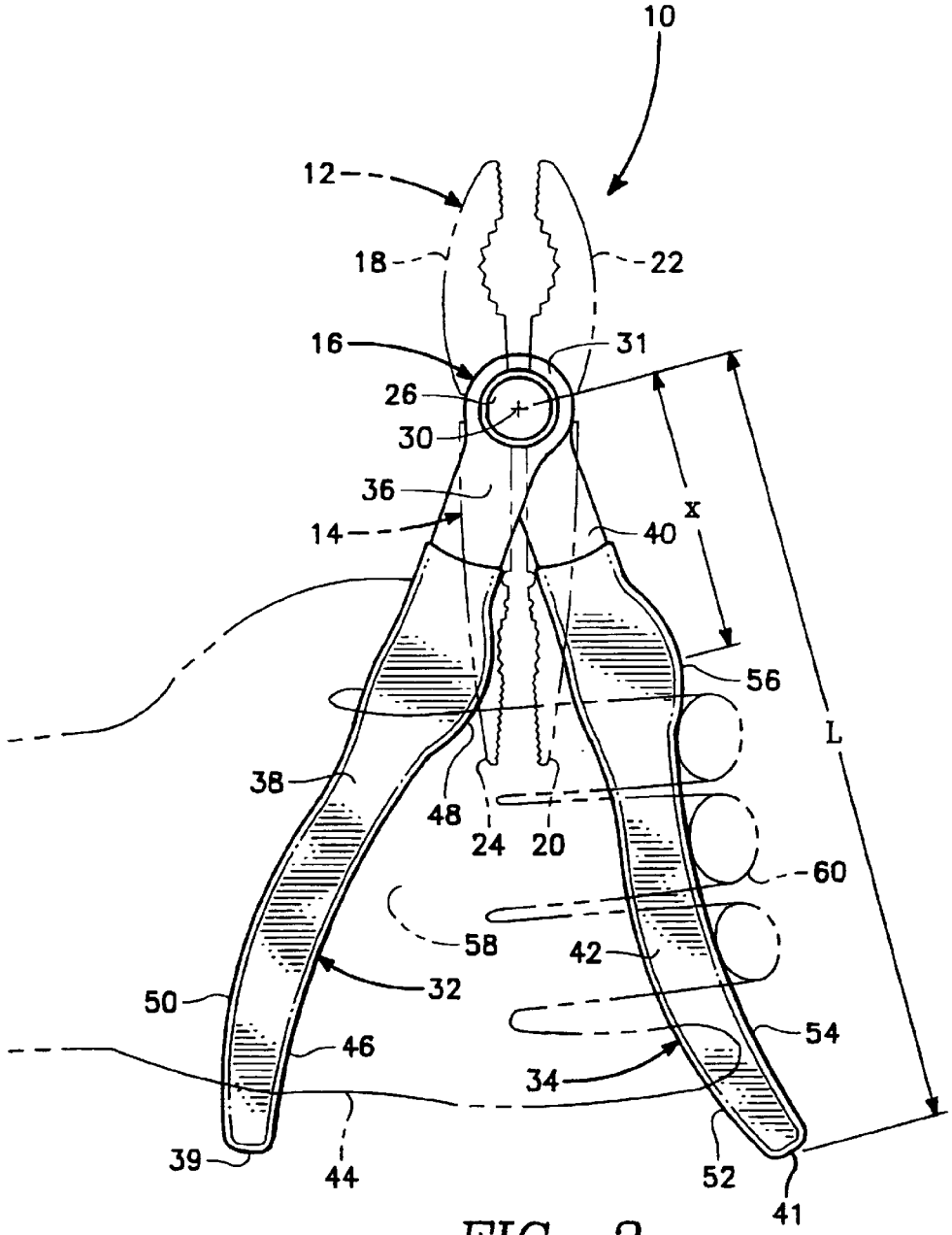
FIG. 3 is a view similar to FIG. 1 but showing the user's hand being placed in conjunction with the pliers.
Figure 4:
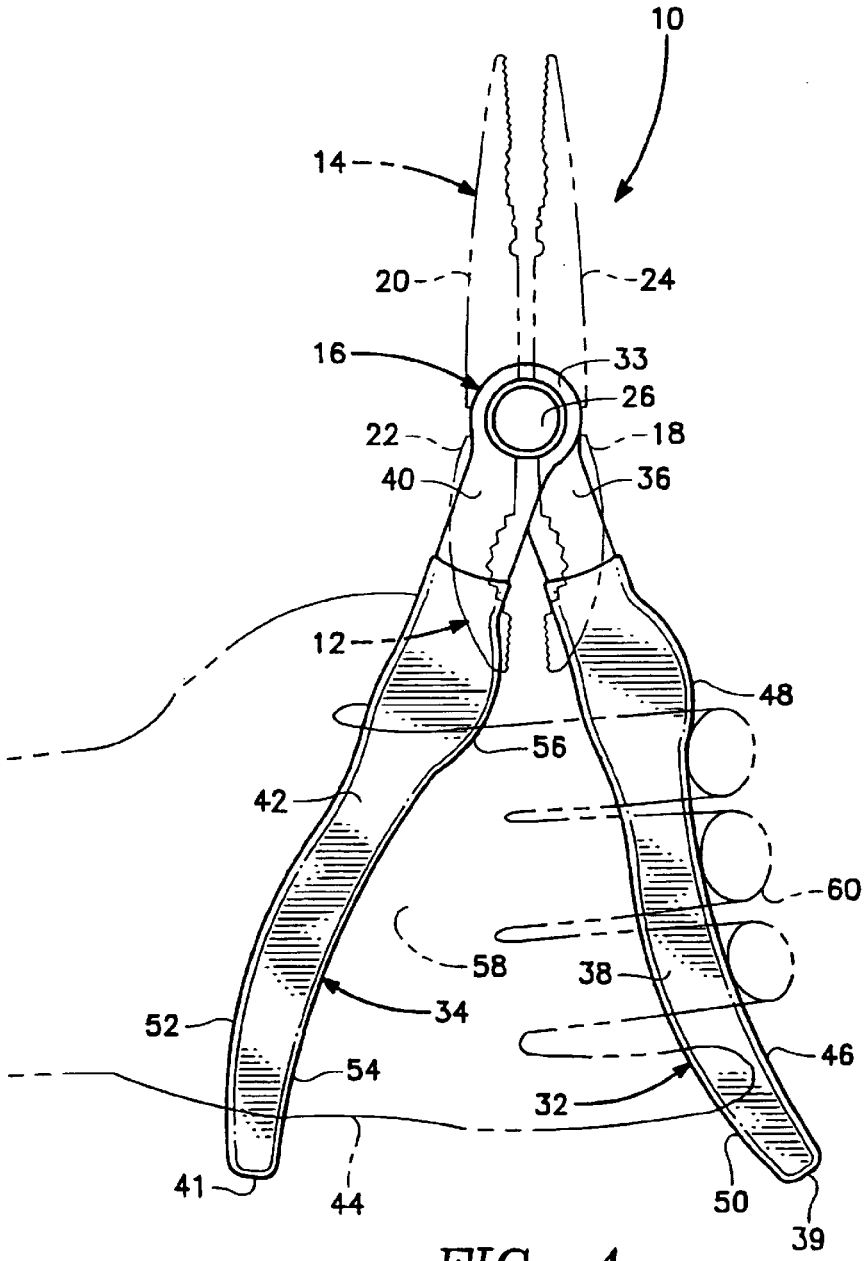
FIG. 4 is a view similar to FIG. 3 but with the needle nose pliers head being located in the usage position and the user's hand mounted in conjunction with the handles.

In reference to the drawings, the jaw elements 18, 20, 22 and 24 are not shown in the totally open position as such are held in a partially open position by a first handle 32 and a second handle 34. Either the snub nose pliers head 12 or the needle nose pliers head 14 is located between the handles 32 and 34. In FIGS. 1 and 3, the needle nose pliers head 14 is shown located between the handles 32 and 34, while in FIG. 4, the snub nose pliers head 12 is shown located between the handles 32 and 34.

The outer end of each handle 32 and 34 is bifurcated which defines a pair of legs 35 and 37 for handle 34 and a pair of legs 31 and 33 for handle 32, and between each of the legs of each pair are located a pair of holes which are in alignment. The bifurcated legs 31 and 33 of handle 32 are located about the bifurcated legs 35 and 37 of handle 34 and then positioned in conjunction with the connecting joint with the pins 26 and 28 extending through the aligned holes and the connecting joints 16. The pins 26 and 28 are then secured together forming a pivot joint that will permit the handles 32 and 34 to be pivoted from the position shown in FIGS. 1 and 3, each about one hundred sixty degrees, which will place the handles 32 and 34 in the position shown in FIG. 4. However, it is to be understood that FIG. 4 has been flopped one hundred eighty degrees so that the needle nose pliers head 14 extends in an upward direction rather than a downward direction.

The first handle 32 includes a metal elongated body 36 which is covered with a rubber or plastic cover 38. Metal body 36 terminates in a free end 39. In a similar manner, the second handle 34 includes a metal elongated body 40 which is covered by a rubber or plastic covering 42. Metal elongated body 40 terminates in a free end 41. The covers 38 and 42 are for the purpose of providing a soft, resilient material to be in contact with the user's hand 44.

The first handle 32 has a lateral inner surface 46, which is shown in FIGS. 1 and 3. This lateral inner surface 46 is concave. This lateral inner surface 46 extends from the free end 39 to a protuberance that is defined as a pommel 48. The lateral exterior surface 50 of the first handle 32, which is shown in FIGS. 1 and 3, is shown to be convex. The curve of the lateral exterior surface 50 is similar to the curve of the lateral inner surface 46 with this similarity being substantially parallel. These curves extend from the free end 39 to the approximate mid-point M (one-half) of the length of the first handle 32. These curves are directly adjacent each other on opposite sides of handle 32.

The second handle 34 has a lateral inner surface 52, in FIGS. 1 and 3, which is convex. The second handle 34 also has a lateral exterior surface 54 which is concave, which is again shown in FIGS. 1 and 3. This lateral exterior surface 54 extends from the free end 44 to a protuberance known as pommel 56. The curve of the lateral exterior surface 54 is similar (substantially parallel) to the curve of the lateral interior surface 52. These curves extend from the free end 41 to the approximate mid-point N (one-half) of the length of the second handle 34. These curves are directly adjacent each other on opposite sides of handle 34. It is to be noted that the distance from the pivot axis 30 to the center of the pommel 56 or the center of the pommel 48 is a distance X, as is shown in FIG. 3. The distance from the pivot axis 30 to the free outer end of either handle 32 or 34 is defined as distance L. Typically, the distance X will be around two to two and one-quarter inches with the distance L being approximately five and one-half inches. The height Y of pommel 48 and the height Z of pommel 56 is at least one-eighth of an inch but not more than three-sixteenths of an inch. The reason it is desired to keep the pommel height less than three-sixteenths of an inch is that if it is greater the pommel will prevent the pliers from completely closing. These distance measurements are important to achieve the desired operability of the pliers while also achieving an attractive appearance which is to encourage sales of the pliers.

When a user grasps the handles 32 and 34 with the pliers 10 in the position shown in FIGS. 1 and 3, the user's palm area 58 rides against the lateral exterior surface 50 and the user's fingers 60 are located within the concave exterior surface 54. The fact that the lateral exterior surface 50 is convex provides for a comfortable positioning and application of torque by the user's hand 44. The fact that the lateral exterior surface 54 is concave forms a nice nesting area for the fingers 60 since a concave configuration is more comfortable than a convex configuration. Also, the pommel 48 functions as a guide to indicate to the user the proper location for the fingers 60. Also, the pommel 48 tends to prevent the user's hand from "sliding up" toward the connecting joint 16. The arrangement between the pommel 48, the concave surface 46 and the convex surface 52 functions to ergonomically mount the user's hand when utilizing of the snub nose pliers head 12.

It is to be noted that regardless of which head 12 or 14 is located extended and in the usage position, there is always a lateral exterior surface (50 or 52) which is convex and available to the user to be pressed into the palm area of the user's hand and a lateral exterior surface (46 or 54) which is concave which comfortably accommodates the user's fingers. To press a concave surface into the palm area of a user's hand is not comfortable to the user. Therefore, regardless of which head 12 or 14 is in the usage position, the user can utilize the pliers 10 so a convex surface of a handle is pressed into the user's palms.

When the handles 32 and 34 are pivoted one hundred sixty degrees, the snub nose pliers head 12 is located between the handles 32 and 34 and in a stowage position with the needle nose pliers head 14 now being exposed for usage. In this particular position, the inner surface 52 now becomes an exterior surface which is to connect with the user's palm area 58. The user's fingers 60 now connect with the inner surface 46 which actually becomes an exterior surface with the fingers 60 nesting within the concave configuration of the inner surface 46. The pommel 56 functions as a positioning device for the user's hand 44 with the pommel 56 concave inner surface 46 and the convex inner surface 52 functioning to ergonomically adapt to the user's hand to facilitate the application of torque by using of the needle nose pliers head 14.

The present invention may be embodied in other specific forms without departing from the essential attributes thereof. Reference should be made to the appending claims rather than the foregoing specification as indicating the scope of the invention.

What is claimed is:

1. A pliers comprising:

a first pliers head, said first pliers head being located within either a usage position or a stowage position;

a second pliers head located opposite said first pliers head, said second pliers head being connected to said first pliers head at a connecting joint, said second pliers head being located in either said usage position or said stowage position, with said first pliers head in said usage position said second pliers head is in said stowage position, with said second pliers head in said usage position said first pliers head is in said stowage position;

a first handle being pivotally connected to said connecting joint, a second handle being pivotally connected to said connecting joint, said first handle terminating in a first free end, said second handle terminating in a second free end, said first handle and said second handle being movable within a plane, both said first handle and said second handle being pivotable about one-hundred and sixty degrees between said usage position and said stowage position;

said first handle having a first convexly curved surface which is laterally displaced relative to said connecting joint and located transverse to said plane, said first convexly curved surface connects with said first free end and extends approximately one-half the total length of said first handle, said first convexly curved surface defining a first curve, said first handle having a first concave surface which is laterally displaced relative to said connecting joint and located transverse to said plane, said first concave surface defines a second curve, said first concave surface connects ith said first free end and extends approximately one-half of the total length of said first handle, said first concave surface forming an exterior surface when said second pliers head is in said usage position;

said second handle having a second convexly curved surface which is laterally displaced relative to said connecting joint and located transverse to said plane, said second convexly curved surface connects with said second free end and extends approximately one-half the total length of said second handle, said second convexly curved surface defining a third curve, said second convexly curved surface defining an exterior surface when said second pliers head is in said usage position, said second handle having a second concave surface which is laterally displaced relative to said connecting joint and located transverse to said plane, said second concave surface defining a fourth curve, said second concave surface connects with said second free end and extends approximately one-half of the total length of said second handle;

said first convexly curved surface defining an exterior surface and said second concave surface defining an exterior surface when said first pliers head is in said usage position, said first convexly curved surface defining an interior surface and said second concave surface defining an interior surface when said first pliers head is in said stowage position; and said second convexly curved surface defining an interior surface and said first concave surface defining an interior surface when said second pliers head is in said stowage position, said first curve being approximately parallel to said second curve end located directly adjacent each other on opposite sides of said first handle, said third curve being approximately parallel to said fourth curve and located directly adjacent each other on opposite sides of said second handle.

2. The pliers as defined in claim 1 wherein:

said stowage position being located between said first handle and said second handle.

3. The pliers as defined in claim 1 wherein:

a first pommel mounted on said first handle, said first pommel being located only on said first concave surface with said first pommel comprising a small smoothly contoured single mounded protrusion which extends outwardly from said first concave surface, said first pommel being located directly adjacent said connecting joint and spaced an extended distance from said first free end, said first pommel to function as a positioning device to abut against an index finger of a user when said second pliers head is in said usage position, said first pommel to assist in determining proper positioning of said pliers within a user's hand, said first pommel having a height of at least one-eighth of an inch but not more than three-sixteenths of an inch.

4. The pliers as defined in claim 3 wherein:

a second pommel formed on said second handle, said second pommel being located only on said second concave surface of said second handle with said second pommel comprising a small smoothly contoured single mounted protuberance which extends outwardly from said second concave surface, sold second pommel being directly adjacent said connecting joint and spaced an extended distance from said second free end, said second pommel to function as a positioning device to abut against an index finger of a user when said first pliers head is in said usage position, said second pommel to assist in determining proper positioning of the pliers within a user's hand, said second pommel having a height of at least one-eighth of an inch but not more than three-sixteenths of an inch.

5. The pliers as defined in claim 4 wherein:

said connecting joint forming a pivot axis, said first pommel and said second pommel being spaced approximately two inches from said pivot axis, said first free end and said second free end being spaced approximately five and one-half inches from said pivot axis.

6. A pliers having a pair of heads defined as a first head and a second head, said heads being reversible between a usage position and a storage position, said pliers comprising:

a pair of elongated handles each of which is pivotable from a first position to a second position, with said handles in said first position said first head is in said usage position and said second head is in said stowage position, with said handles in said second position said first head is in said stowage position and said second head is in said usage stowage position;

with said handles in either said first position or said second position one of said handles has a laterally exterior convex surface and a laterally interior concave surface while another of said handles has a laterally exterior concave surface and a laterally interior convex surface in another of said handles, said laterally exterior convex surface being located directly opposite said laterally interior concave surface on one of said handles, said laterally exterior concave surface being located directly opposite said laterally interior convex surface, whereby when said handles are held by a user in one's hand there is always available a laterally exterior convex surface to press against a palm area of one's hand and a laterally exterior concave surface in which fingers of one's hand are to be located in both said first position and said second position which is ergonomically comfortable to the user when using of said pliers; and each of said handle having a pommel, there being a said pommel formed directly adjacent said laterally interior concave surface and said laterally exterior concave surface with these two pommels being the only pommels on said pliers, each said pommel to further ergonomically assist in grasping of said handles.

7. A pliers having a pair of heads defined as a first head and a second head, said heads being reversible between a usage position and a stowage position, said pliers comprising:

pair of elongated handles each of which is pivotable from a first position to a second position, with said handles in said first position said first head is in said usage position and said second head is in said stowage position, with said handles in said second position said first head is in said stowage position and said second head is in said usage position, said handles to be located in juxtaposition in both said usage position and said stowage position;

with said handles in either said first position or said second position one of said handles has a laterally exterior convex surface and a laterally interior concave surface while another of said handles has a laterally exterior concave surface and a laterally interior convex surface in another of said handles, said laterally exterior convex surface being located directly opposite said laterally interior concave surface on one of sold handles, said laterally exterior concave, surface being located directly opposite said laterally interior convex surface, whereby when said handles are held by a user in one's hand there is always available a laterally exterior convex surface to press against a palm area of one's hand and a laterally exterior concave surface in which fingers of one's hand are to be located in both said first position and said second position which is ergonomically comfortable to the user when using of said pliers; and each said handle having a free end, each said convex surface and each said concave surface extending from a said free end.

8. The pliers as defined in claim 7, wherein:

each said convex surface and each said concave surface extending approximately one-half the total length of its respective handle of said handles.

9. The pliers as defined in claim 8 wherein:

each said concave surface on said handles being approximately the same curvature as said convex surface that is also formed on the same handle.

* * * * *